US006328823B1

(12) United States Patent
Deicke et al.

(10) Patent No.: US 6,328,823 B1
(45) Date of Patent: Dec. 11, 2001

(54) ALUMINUM SLIDING BEARING ALLOY

(75) Inventors: Klaus Deicke, Untereisesheim; Werner Schubert, Wiesloch; Thomas Steffens, Bad-Rappenau; Thomas Pomocnik, Oedheim, all of (DE)

(73) Assignee: KS Gleitlager GmbH, St. Leon-Rot (DE)

( * ) Notice: Subject to any disclaimer, the term of this patent is extended or adjusted under 35 U.S.C. 154(b) by 0 days.

(21) Appl. No.: 09/582,531

(22) PCT Filed: Oct. 29, 1998

(86) PCT No.: PCT/EP98/06856

§ 371 Date: Jun. 28, 2000

§ 102(e) Date: Jun. 28, 2000

(87) PCT Pub. No.: WO99/35296

PCT Pub. Date: Jul. 15, 1999

(30) Foreign Application Priority Data

Jan. 8, 1998 (DE) ..... 198 00 433

(51) Int. Cl.[7] ..... C22C 21/00; B22B 11/20

(52) U.S. Cl. ..... 148/439; 148/551; 164/454; 164/455

(58) Field of Search ..... 148/551, 439; 164/455, 454

(56) References Cited

U.S. PATENT DOCUMENTS

| | | | | |
|---|---|---|---|---|
| 4,170,469 | * | 10/1979 | Mori | 75/141 |
| 4,996,025 | * | 2/1991 | Pratt et al. | 420/554 |
| 5,053,286 | | 10/1991 | Pratt . | |
| 5,453,244 | * | 9/1995 | Tamaka et al. | 420/532 |
| 5,846,347 | * | 12/1998 | Tanaka et al. | 148/439 |

FOREIGN PATENT DOCUMENTS

| | | |
|---|---|---|
| W 1271. 40b | | |
| 18 | 9/1951 | (DE) . |
| 28 09 866 | 2/1979 | (DE) . |
| 43 17 989 | 12/1993 | (DE) . |
| 0 440 275 | 8/1991 | (EP) . |
| WO 87 04 | | |
| 377 | 7/1987 | (WO) . |

* cited by examiner

*Primary Examiner*—George Wyszomierski
*Assistant Examiner*—Janelle Combs-Morillo
(74) *Attorney, Agent, or Firm*—Paul Vincent

(57) ABSTRACT

The invention relates to an aluminum sliding bearing alloy, comprising 3 to 6 mass % zinc, 0.3 to 2.0 mass % copper, 0.2 to 1.0 mass % magnesium, 0.3 to 2.0 mass % silicon and 2 to 4.5 mass % lead. According to the invention, said alloy is obtained by means of continuous casting with a minimum dimension, i.e. a strand thickness of more than 20 mm, solidifying in a mold which is indirectly cooled only, with a withdrawal speed of 1 to 5 mm/s and with a cooling speed of less than 100 K/s.

7 Claims, 5 Drawing Sheets

ALUMINUM SLIDING BEARING ALLOY

BACKGROUND OF THE INVENTION

The invention concerns a method for manufacturing a cast product comprising an aluminum friction bearing alloy having portions of zinc, copper, magnesium, silicon and lead, as well as the product itself. A friction bearing alloy of this kind is e.g. Alzn4.5CuMgSiPb which the applicant has been producing for some time under the trade name KS 961. This friction bearing alloy is distinguished by its high stability under load. It has not been possible up to now to increase the lead content to a satisfactory degree for improving the emergency running properties, i.e. to increase resistance to scuffing, since with lead contents of more than 1 mass %, phase separation occurs in the liquid melt in the form of a precipitation of a liquid lead phase. This separation for higher lead content of the aluminum alloy friction bearing prevents formation of finely distributed lead precipitates. It has not been previously possible to produce a superior quality friction bearing material of this kind. EP 0 440 275 A1 proposes a continuous casting method for an aluminum alloy which can comprise one or more of the following components: 1 to 50 mass % lead, 3 to 50 mass % bismuth and 15 to 50 mass % indium and additionally one or more of the components: 0.1 to 20 mass % silicon, 0.1 to 20 mass % tin, 0.1 to 10 mass % zinc, 0.1 to 5 mass % magnesium, 0.1 to 5 mass % copper, 0.05 to 3 weights iron, 0.05 to 3 mass % manganese, 0.05 to 3 mass % nickel and 0.01 to 0.3 mass % titanium, wherein the billet is chilled with direct cooling water at a rate of 700 K/s. This procedure is intended to prevent formation of large-volume minority phase precipitates during the time period between arrival at the segregation temperature and solidification of the matrix metal. It has, however, turned out that direct water cooling of the solidifying billet is associated with large temporal and spatial fluctuations in the cooling rate, leading to inhomogeneities in the cast product. Process stability required for series production cannot be achieved in a reproducible fashion. Moreover, due to the very high cooling rate, there is the considerable danger that cracks are formed in the cast product.

It is therefore the underlying purpose of the present invention to improve the emergency running properties of the above-mentioned aluminum alloy friction bearing.

SUMMARY OF THE INVENTION

This object is achieved in accordance with the invention by a continuous casting method and with a continuously cast product made from aluminum friction bearing alloy having the features claimed.

The aluminum alloy friction bearing is preferably cast vertically

The cooling rate of less than 100 K/s is achieved in that the alloy or the solidifying billet is not cooled by direct chilling of the billet but by directing cooling agent onto the chilled casting mold.

In accordance with the invention, it has been determined for the first time that aluminum alloy friction bearings of the mentioned type comprising an increased lead content of 1.9 to 4.5 mass %, in particular from 2 to 4.5, from 2 to 4, from 2.5 to 4, or from 2.5 to 3.5 mass %, can be produced using the above-mentioned processing method with satisfactory quality with respect to the cast structure. The cooling rate of continuous casting is preferably between 20 and 50 K/s. The withdrawal rate of the billet is preferably between 1.5 and 2.5 mm/s.

The inventive friction bearing alloy is advantageously characterized in that 90% of the drop-shaped lead precipitates have dimensions of less than 10 $\mu$m.

It has turned out that with a lead content of more than 2.5 mass % somewhat larger lead balls of a diameter of up to approximately 20 $\mu$m are sometimes produced. These have, however, no negative effects on the strength of the friction bearing material.

Only with lead contents of approximately 3.5 mass % and more, are larger lead balls, having sizes up to a maximum of 50 $\mu$m, more frequently produced. It has, however, generally turned out that with lead contents of up to 4 mass %, and in any event, of up to 3.5 mass %, the cast structure does not show any significant stability loss.

DESCRIPTION OF THE PREFERRED EMBODIMENTS

Figure 1:
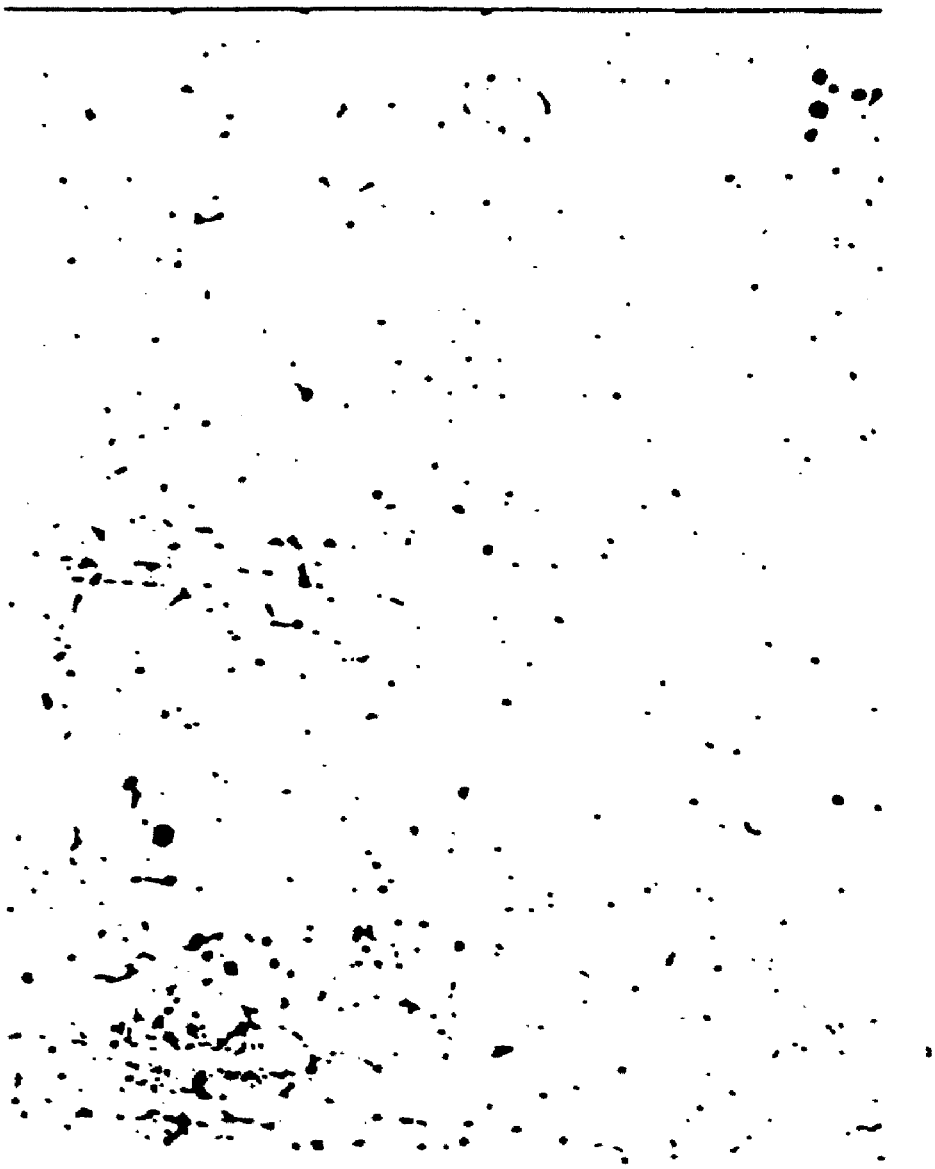
FIG. 1 shows a photomicrograph of a first aluminum friction bearing alloy manufactured with the method in accordance with the invention.

FIG. 1 shows the photomicrograph of AlZn4.5CuMgSiPb1.9. The furnace temperature was 775° C. and the distributor temperature of the continuous cast system was set to 745° C. The chilled mold temperature was 720° C. The casting or withdrawal rate of the billet was approximately 2 mm/s.

The result is a perfect structure which does not differ from that of the conventional aluminum alloy friction bearing KS 961.

Figure 2:
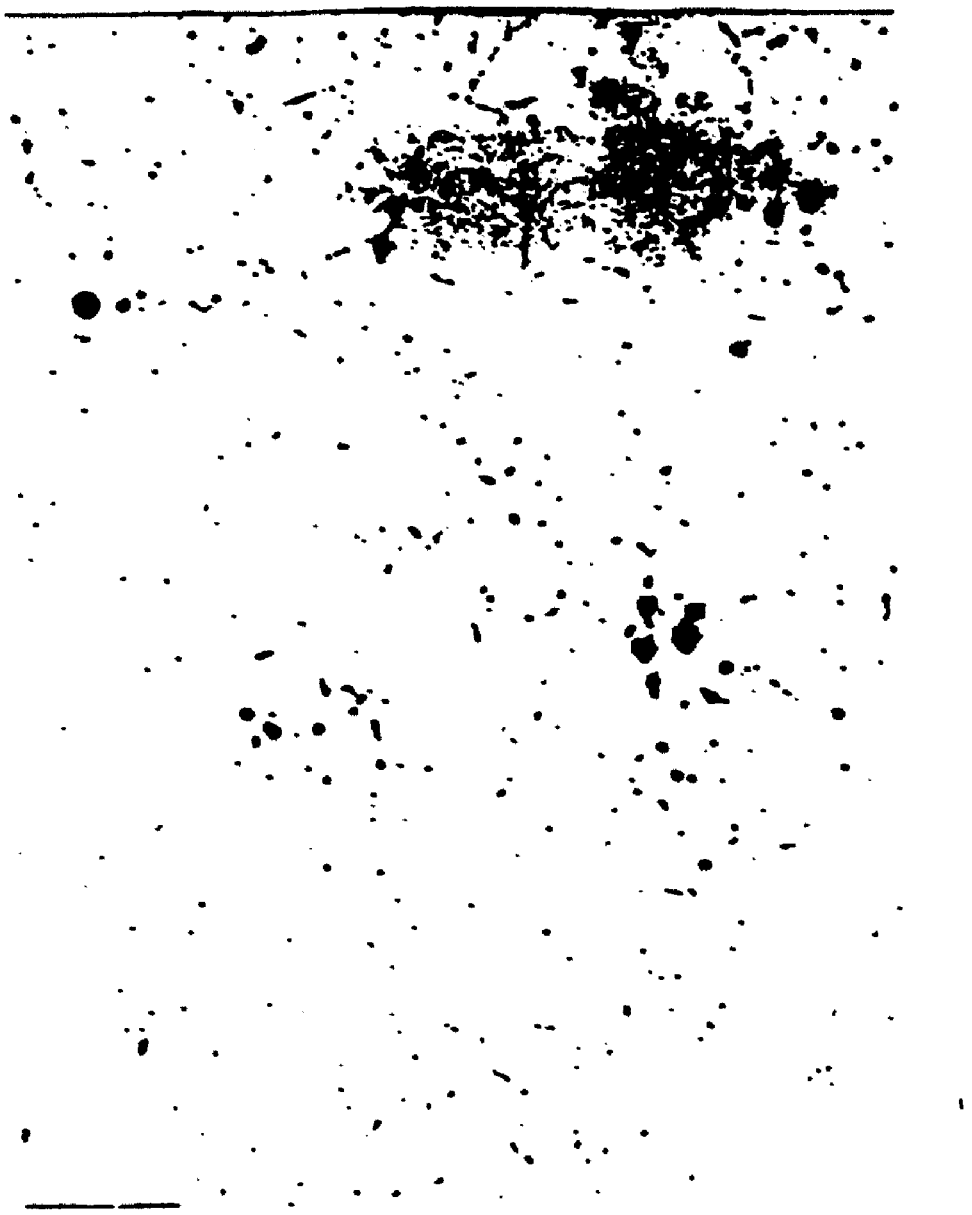
FIG. 2 shows a photomicrograph of a second aluminum friction bearing alloy manufactured with the method in accordance with the invention.

Similar results are obtained for the alloy according to FIG. 2 which differs from the one of FIG. 1 in that the lead content is 2.5 mass %. The furnace temperature was slightly increased to 780° C. The distribution temperature and the chilled mold temperature remained unchanged at 745° C. and 720° C., respectively.

Figure 3:
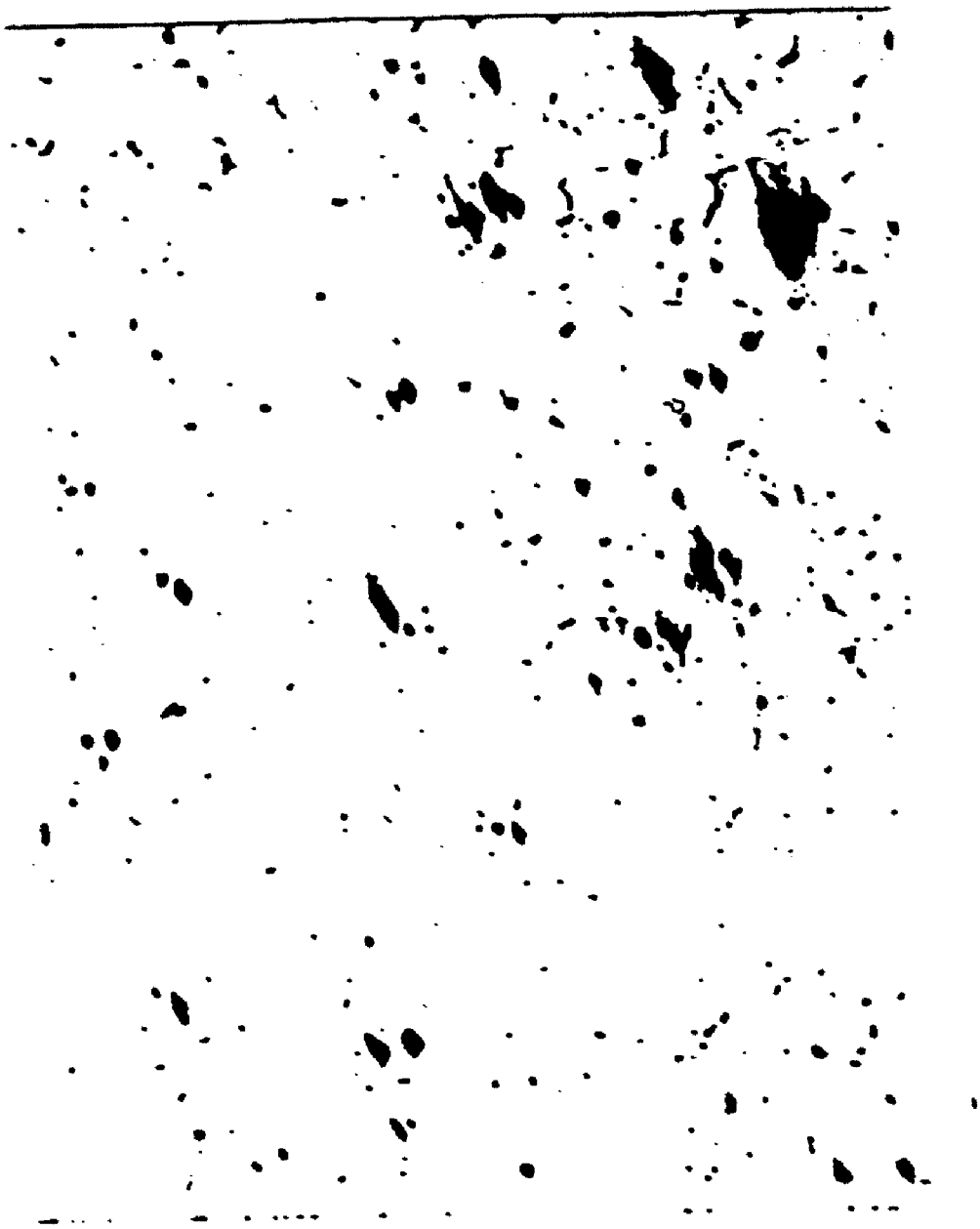
FIG. 3 shows a photomicrograph of a third aluminum friction bearing alloy manufactured with the method in accordance with the invention.

FIG. 3 shows the photomicrograph of an aluminum alloy friction bearing which differs from the one of FIG. 1 in that it contains 3 mass % lead. The furnace temperature was 805° C., the distributor temperature was 765° C. and the chilled mold temperature was 740° C. The temperatures were increased since the segregation temperature in the phase diagram increases with increasing lead concentration.

Figure 4:
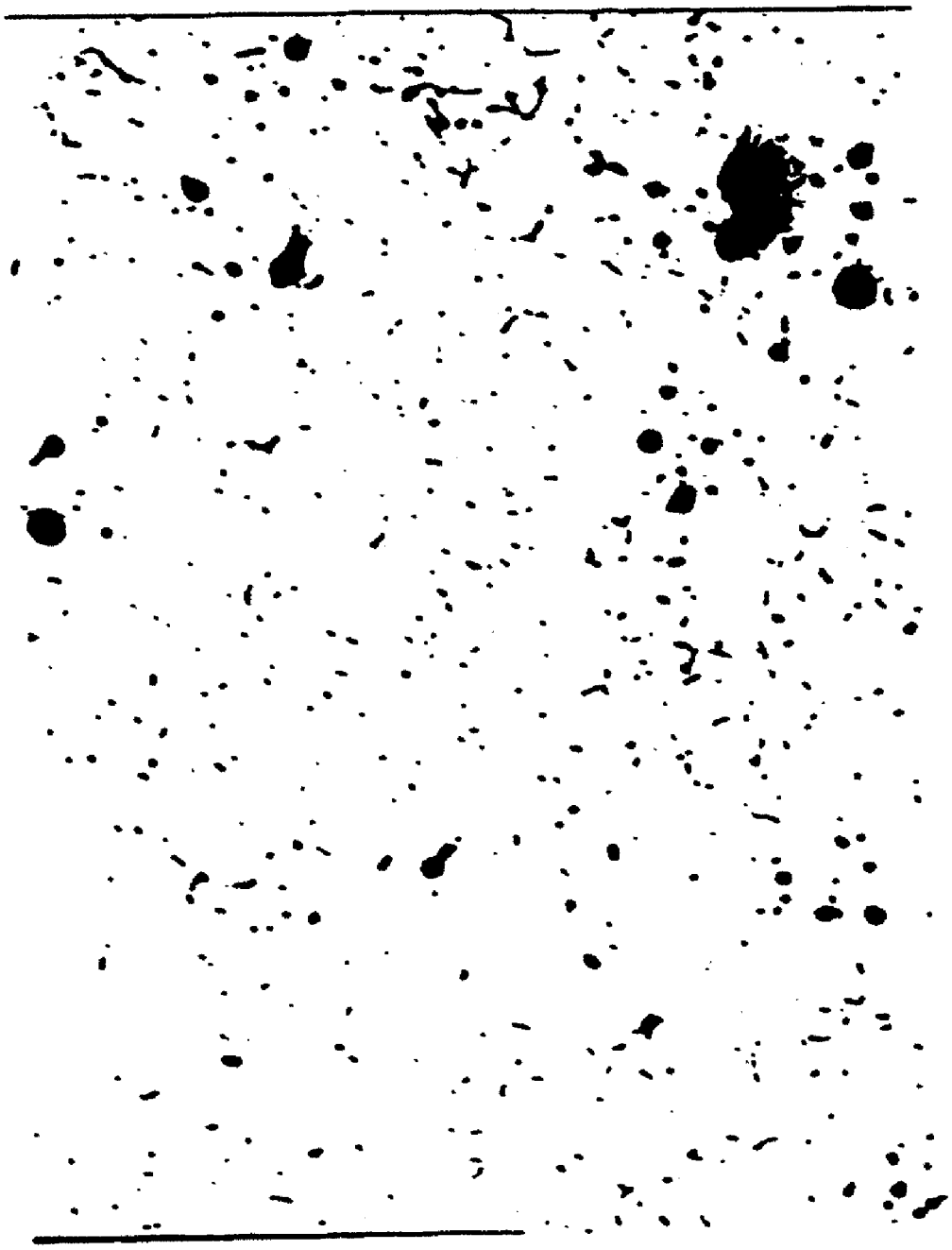
FIG. 4 shows a photomicrograph of a fourth aluminum friction bearing alloy manufactured with the method in accordance with the invention.

FIG. 4 shows the photomicrograph of a corresponding aluminum alloy friction bearing with 3.7 mass % lead. The furnace temperature was 815° C., the distributor temperature was 775° C. and the chilled mold temperature was 750° C.

Figure 5:
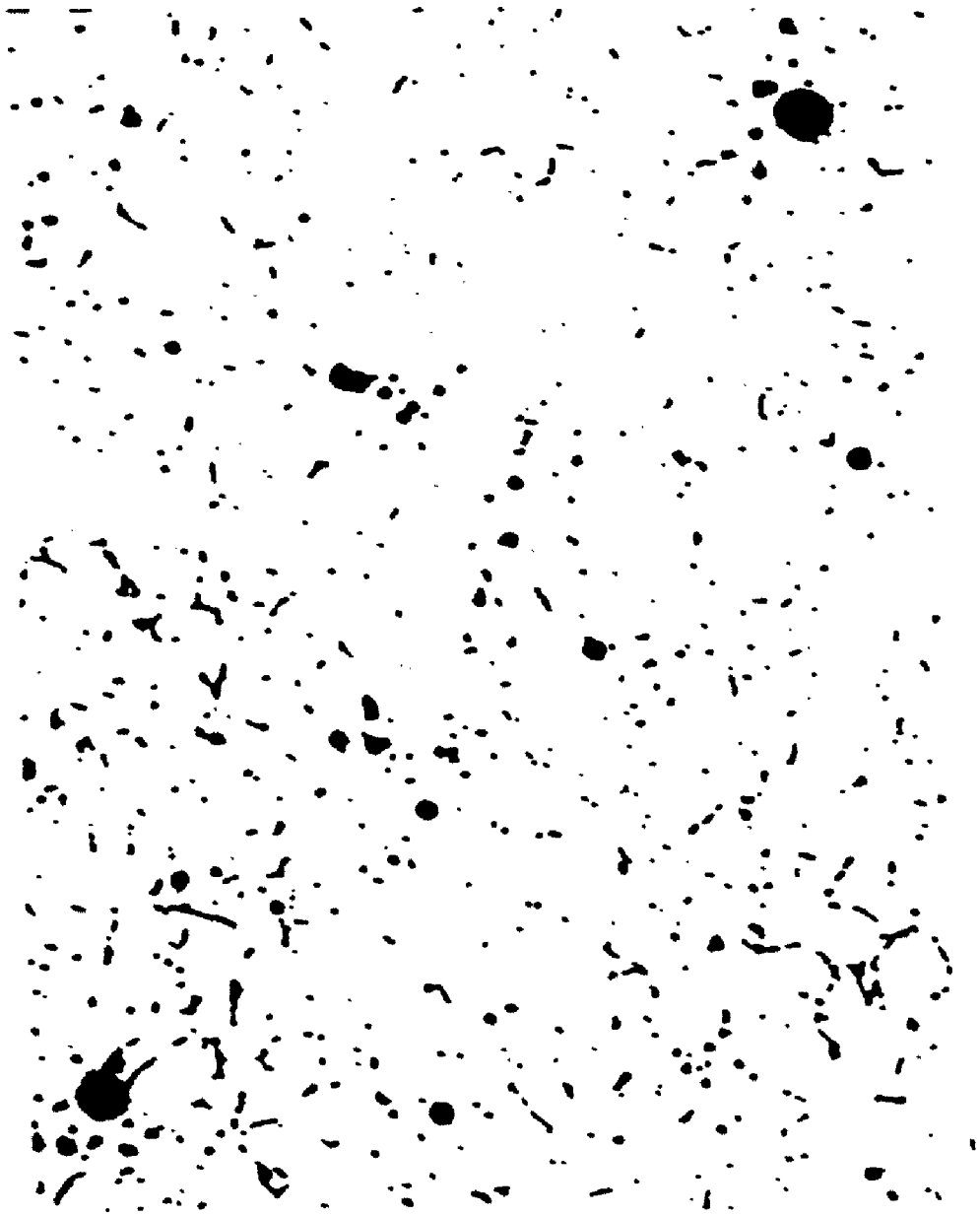
FIG. 5 shows a photomicrograph of a fifth aluminum friction bearing alloy manufactured with the method in accordance with the invention.

FIG. 5 shows the photomicrograph obtained after casting of the alloy according to FIG. 4 which has an additional 0.2 mass % zinc and thus contains only 3.6 mass % lead. The structure contains a larger portion of finer lead precipitates than FIG. 4. The casting parameters corresponded to those of the above-mentioned embodiment of FIG. 4.

What is claimed is:

1. A method for manufacturing a continuously cast product from an aluminum friction bearing alloy, the method comprising the steps of:

a) preparing an alloy, said alloy consisting essentially of 3 to 6 mass % zinc, 0.3 to 2.0 mass % copper, 0.2 to 1.0 mass % magnesium, 0.3 to 2.0 mass % silicon, 1.9 to 4.5 mass % lead, the rest aluminum, unavoidable impurities and up to 0.2 mass % tin;

b) introducing said alloy into an exclusively indirectly cooled chilled mold;

c) continuously casting said alloy in said chilled mold with a billet thickness of more than 20 mm, a withdrawal rate of 1 to 5 mm/s, and a cooling rate of less than 100 K/s.

2. The method of claim 1, wherein said cooling rate during continuous casting is between 20 and 50 K/s.

3. The method of claim 1, wherein said withdrawal rate during continuous casting is between 1.5 to 2.5 mm/s.

4. A continuously cast aluminum friction bearing alloy consisting essentially of 3 to 6 mass % zinc, 0.3 to 2.0 mass % copper, 0.2 to 1 mass % magnesium, 0.3 to 2.0 mass % silicon and 3.25 to 4.5 mass % lead, the rest aluminum, unavoidable impurities, and up to 0.2 mass % tin, wherein the lead comprises finely distributed precipitates with 90% of drop-shaped lead precipitates having dimensions of less than 10 $\mu$m.

5. The continuously cast alloy of claim 4, wherein said alloy comprises 2 to 4 mass % lead.

6. The continuously alloy of claim 4, wherein said alloy comprises 2.5 to 4 mass % lead.

7. The continuously cast alloy of claim 4, wherein said alloy comprises 2.5 to 3.5 mass % lead.

* * * * *